United States Patent [19]

Carr et al.

[11] Patent Number: 4,826,633

[45] Date of Patent: May 2, 1989

[54] SYNTHETIC LUBRICANT BASE STOCK OF MONOPENTAERYTHRITOL AND TRIMETHYLOLPROPANE ESTERS

[75] Inventors: Dale D. Carr, Morristown; Nicholas DeGeorge, deceased, late of Metuchen, both of N.J., by Isabella DeGeorge, executrix

[73] Assignee: Hatco Chemical Corporation, Fords, N.J.

[21] Appl. No.: 919,531

[22] Filed: Oct. 16, 1986

[51] Int. Cl.[4] ..... C10M 105/38

[52] U.S. Cl. ..... 252/56 S

[58] Field of Search ..... 252/56 S

[56] References Cited

U.S. PATENT DOCUMENTS

| | | | |
|---|---|---|---|
| 3,247,111 | 4/1966 | Oberright | 252/56 S |
| 3,620,290 | 11/1971 | Kress et al. | 252/56 S |
| 3,850,824 | 11/1974 | Nebzydoski et al. | 252/56 S |
| 4,049,563 | 9/1977 | Burrous | 252/56 S |
| 4,053,491 | 11/1977 | Koch et al. | 252/56 S |
| 4,064,058 | 12/1977 | Walker | 252/56 S |
| 4,113,635 | 9/1978 | Sakurai et al. | 252/56 S |
| 4,113,642 | 9/1978 | Koch et al. | 252/56 S |
| 4,119,551 | 10/1978 | Yaffe | 252/56 S |
| 4,175,045 | 11/1979 | Timony | 252/56 S |
| 4,178,261 | 12/1979 | Dheen et al. | 252/56 S |
| 4,263,159 | 4/1981 | Berens et al. | 252/56 S |
| 4,320,018 | 3/1982 | Yaffe | 252/56 S |

*Primary Examiner*—William R. Dixon, Jr.
*Assistant Examiner*—Jerry D. Johnson
*Attorney, Agent, or Firm*—Blum Kaplan

[57] ABSTRACT

An improved synthetic ester lubricant base stock formed by reacting at least one of trimethylolpropane and monopentaerythritol with a mixture of aliphatic monocarboxylic acids is provided. The mixture of acids including straight-chain acids having from 5 to 10 carbon atoms and an iso-acid having from 6 to 10 carbon atoms, preferably iso-nonanoic acid. The base stock is mixed with a conventional ester lubricant additive package to form a lubricant having a viscosity at 210° F. of at leasts 5.0 centistokes and pour point of at least as low as −65° F. The resulting lubricants have a decreased tendency to form deposits in gas turbine engines.

19 Claims, No Drawings

SYNTHETIC LUBRICANT BASE STOCK OF MONOPENTAERYTHRITOL AND TRIMETHYLOLPROPANE ESTERS

BACKGROUND OF THE INVENTION

This invention relates to synthetic lubricant base stock and, in particular, to a synthetic lubricant ester base stock having a decreased tendency to form deposits in gas turbine engines.

Synthetic ester base stocks for use in lubricants for gas turbine engines are well known. The base stocks are combined with standard lubricant additive packages to form the lubricant. In order for the lubricant to have properties suitable for use in the engine, the base stock must have certain physical properties. For example, it is desirable that the lubricant meet the specifications of the bearing rig test referred to in military specification MIL-L-23699C. The MIL-L-23699C specification also requires that the viscosity of the lubricant at 210° F. be at least 5.0 centistokes (cSt) and the viscosity at −40° F. must be less than 13,000 cSt. The highest allowable pour point for the lubricant is −65° F. The pour point is the lowest temperature at which the base stock will flow as a liquid.

In general, synthetic gas turbine engine lubricants use esters as a base stock. The esters are a mixture of monopentaerythritol esters and dipentaerythritol esters. Alternatively, a mixture of trimethylolpropane esters and dipentaerythritol esters are used. The presence of the dipentaerythritol esters is generally considered necessary for imparting the required viscosity characteristics to the lubricant.

For example, U.S. Pat. No. 3,694,382, issued to Kleiman et al on Sept. 26, 1972, discloses an ester blend for use as a synthetic lubricant. The ester blend includes esters of trimethylolpropane and dipentaerythritol formed from a mixture of aliphatic monocarboxylic acids.

U.S. Pat. No. 4,049,563, issued to Burrous on Sept. 20, 1977, discloses a jet engine oil consisting of an ester of a $C_4$–$C_{12}$ monocarboxylic acid, a polyol selected from pentaerythritol, dipentaerythritol, tripentaerythritol, trimethylolpropane, trimethylolmethane, trimethylolbutane, neopentylglycol and mixtures thereof and a soluble methyl phenyl polysiloxane.

U.S. Pat. No. 4,064,058, issued to Walker on Dec. 20, 1977, discloses a grease base stock including a blend of a normally liquid pentaerythritol ester product and a neopentyl glycol ester product.

U.S. Pat. No. 3,360,465 issued to Warman on Dec. 26, 1967 discloses synthetic ester lubricant compositions of pentaerythritol mixed esters. The pentaerythritol utilized includes at least 1.5 weight percent dipentaerythritol. The acid includes a mixture of from two to six monocarboxylic alkanoic acids having from five to nine carbon atoms with some of the lower acids being branched chain.

Every lubricant has a characteristic tendency to form deposits when used in an engine. If the deposits are excessive they will detract from the operating efficiency of the engine and create problems such as filter plugging. It has been found that esters formed from dipentaerythritol have a greater tendency to form deposits in gas turbine engines than esters formed from monopentaerythritol and trimethylolpropane. This is true whether or not the dipentaerythritOl esters are present alone or in combination with monopentaerythritol esters and/or trimethylolpropane esters.

Accordingly, it is desirable to provide a synthetic lubricant base stock which provides lubricants having acceptable viscosity and pour point characteristics without including esters of dipentaerythritol.

SUMMARY OF THE INVENTION

Generally speaking, in accordance with the invention an improved synthetic ester base stock is prepared by reacting at least one of monopentaerythritol (MPE) and trimethylolpropane (TMP) with a mixture of monocarboxylic acids, including a $C_5$–$C_{10}$ normal alkanoic acid and iso-nonanoic acid is provided. The straight chain monocarboxylic acids include those having between 5 and 10 carbon atoms, such as valeric acid (pentanoic acid), caproic acid (hexanoic acid), oenanthic acid (heptanoic acid), caprylic acid (octanoic acid), pelargonic acid (nonanoic acid) and capric acid (decanoic acid). The iso-nonanoic acid provides the necessary viscosity characteristics and permits elimination of the dipentaerythritol esters. The synthetic ester base stock of the invention when mixed with a standard lubricant additive package provides a lubricant having a viscosity at 210° F. of at least about 5.0 centistokes and a pour point of at least as low as about −65° F.

Accordingly, it is an object of the invention to provide an improved synthetic polyol ester base stock.

Another object of the invention is to provide an improved synthetic ester base stock having a decreased tendency to form deposits when used in a gas turbine engine.

A further object of the invention is to provide a synthetic ester base stock which when combined with a standard lubricant additive package provides a lubricant meeting military specification MIL-L-23699C with a viscosity at 210° F. of at least 5.0 centistokes and a pour point of less than at least −65° F.

Still a further object of the invention is to provide a synthetic polyol ester base stock for providing synthetic ester lubricants having acceptable viscosity characteristics and pour point without including esters of dipentaerythritol.

Still other objects and advantages of the invention will in part be obvious and will in part be apparent from the specification.

The invention accordingly comprises a composition of matter possessing the characteristics, properties, and the relation of components which will be exemplified in the composition hereinafter described, and the scope of the invention will be indicated in the claims.

DESCRIPTION OF THE PREFERRED EMBODIMENTS

The synthetic lubricant base stock prepared in accordance with the invention is to be used with standard lubricant additive packages. The lubricant base stock prepared in accordance with the invention is the reaction product of a polyol mixture with a monocarboxylic acid mixture. The base stock when mixed with a standard lubricant additive package meets military specification MIL-L-23699C. The lubricant has a viscosity at 210° F. of at least about 5.0 centistokes and a pour point of less than about −65° F.

The polyol is a mixture of monopentaerythritol (MPE; specifically, MPE CAS #=115-77-5) and trimethylolpropane (TMP; specifically, TMP CAS #=77-99-6). The MPE has the formula $C_5H_{12}O_4$. It is a colorless solid with a melting point of 255°-259° C. The TMP has the formula $C_6H_{14}O_3$. TMP is a colorless solid with a melting point of 60°-62° C. In the preferred embodiments of the invention, the relative amounts of MPE and TMP by weight in the polyol range between about 60 and 80% MPE to about 20 and 40% TMP. In the preferred embodiments, the mixture includes about 70% MPE and 30% TMP.

The acid component is a mixtur of straight chain acids having 5 to 10 carbon atoms and a branched chain acid having from 7 to 10 carbon atoms, preferably nine carbon atoms, namely isononanoic acid. Generally, the acids are monocarboxylic acids. Suitable straight chain acids include, but are not limited to, valeric acid, oenanthic acid, caprylic acid, pelargonic acid and capric acid.

The branched chain acid may be iso-$C_7$, iso-$C_8$, iso-$C_9$ or iso-$C_{10}$. Preferably, the branched chain acid used is the iso-$C_9$ acid or iso-nonanoic acid, also known as 3,5,5-trimethylhexanoic acid (3,5,5-trimethylhexanoic acid CAS $\pi$=[03302-10-1]). As used herein, iso-$C_9$ or iso-nonanoic acid is 3,5,5-trimethylhexanoic acid and has the formula:

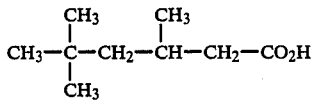

Addition of the iso-nonanoic acid provides the necessary viscosity characteristics and permits elimination of the dipentaerythritol. The iso-nonanoic acid also improves the pour point of the base stock.

The iso-acids other than iso-nonanoic can be used to provide base stocks which are suitable for turbine engine lubricant applications. For example, iso-$C_7$, iso-$C_8$ and iso-$C_{10}$ acids are available, but these acids contain a complex mixture of isomers, unlike iso-$C_9$ acid which is mainly 3,5,5-trimethylhexanoic acid. The physical properties of an acid that is a complex mixture of isomers can change if the relative ratios of the isomeric components change and this affects the properties of an ester produced from the acid. Therefore, to produce a consistent product ester, it is preferable to use raw materials that consist of a single, high purity component, namely iso-$C_9$ or iso-nonanoic acid.

The acid mixture is present in the reaction in an excess of about 5 to 10 weight percent for the amount of the polyol mixture used. The excess acid is used to force the reaction to completion. The excess acid is not critical to carrying out the reaction except that the smaller the excess, the longer the reaction time. After the reaction is complete, the excess acid is removed by stripping and refining. Generally, the esterification reaction is carried out in the presence of conventional catalysts. For example, a tin catalyst such as tin oxalate may be used.

Lubricants including ester base stocks prepared in accordance with the invention are prepared by mixing a conventional additive package to the base stocks in conventional concentrations. Typical additive packages are described in U.S. Pat. Nos. 4,124,513, 4,141,845 and 4,440,657. The two former patents describe additive packages based on an alkylphenyl or alkarylphenyl naphthylamine, a dialkyldiphenylamine, a polyhydroxy anthraquinone, a hydrocarbyl phosphate ester with an S-alkyl-2-mercaptobenzotriazole or an N-(alkyl)-benzothiazole-2-thione. The third patent describes additives of a selected tertiarybutylphenyl substituted phosphate and a selected alkyl amine.

The invention will be better understood with reference to the following examples. All percentages are set forth in percent by weight. These examples are presented for purposes of illustration only and are not intended to be construed in a limiting sense.

Examples 1-12

A variety of ester base stocks were prepared. In each of the following runs the raw materials identified in the TABLE and a tin oxalate catalyst were charged to a stirred reactor capable of delivering 460°-490° F. and a vacuum of at least 29 inches of mercury. The reactor was provided with a nitrogen sparge or blanket. The charge was heated to a reaction temperature between about 440° and 450° F. and the water of reaction was collected in a trap while the acids were returned to the reactor. As reflux slowed, vacuum was applied in order to maintain a reasonable refux rate. When the hydroxyl value was reduced to a sufficiently low level (a maximum of 5.0 mg KOH/gm), the bulk of the excess acid was removed by distillation at the reaction temperature and maximum vacuum. The residual acidity was removed by treatment with lime and water. The resulting ester base stock was dried and filtered.

The viscosity at 210° F. and −40° F. was determined in accordance with ASTM D-445 for each sample base stock together with the pour point in accordance with ASTM D-97.

TABLE

| | RUN | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| RAW MATERIALS | | | | | | | | | | | | |
| Mono PE | 14.54 | 13.71 | 14.62 | — | 13.75 | — | — | 14.74 | 14.08 | 20.03 | 20.29 | 14.52 |
| TMP | 5.94 | 7.83 | 5.97 | 20.98 | 7.85 | 21.57 | 21.83 | 5.15 | 5.83 | — | — | 6.02 |
| Heptanoic | 58.31 | 44.99 | 61.79 | — | 44.11 | — | 6.56 | 41.92 | 59.71 | 53.36 | 57.14 | 61.62 |
| Isononanoic | 14.10 | 17.16 | 17.62 | 21.54 | 19.03 | 19.71 | 28.25 | 18.60 | 13.40 | 16.17 | 11.29 | 16.17 |
| Capric-Caprylic | 7.11 | 16.30 | — | 38.09 | 15.26 | 31.00 | 43.37 | 13.59 | 6.99 | — | — | 1.67 |
| Pelargonic | — | — | — | 19.38 | — | 27.71 | — | — | — | — | — | — |
| Valeric | — | — | — | — | — | — | — | 6.01 | — | 10.44 | — | — |
| Isovaleric | — | — | — | — | — | — | — | — | — | — | 11.29 | — |
| PHYSICAL PROPERTIES | | | | | | | | | | | | |
| Visc @ 210 F., cSt | 5.01 | 4.98 | 5.04 | 4.94 | 5.04 | 4.97 | 4.95 | 5.16 | 4.94 | 5.22 | 4.98 | 4.95 |
| Visc @ −40 F., cSt | 8970 | 9060 | 9350 | 8460 | 9610 | 8130 | 10200 | 10100 | 7450 | 11400 | 9200 | 8325 |
| Pour Point, °F. | −70 | −70 | −70 | −75 | −70 | −75 | −70 | −70 | −70 | −65 | −65 | −70 |

Lubricants prepared in accordance with the invention have a decreased tendency to form deposits when used in gas turbine engines. This reduced tendency was demonstrated by mixing base stock with an additive package as follows:

Additive Package For Panel Test Work

| Component | Parts by weight |
|---|---|
| Base Stock | 100 |
| Tricresyl Phosphate | 2.0 |
| p,p' - Dioctyl-diphenylamine | 1.5 |
| Octylphenyl-α-naphthylamine | 1.5 |
| Benzotriazole | 0.05 |

This additive package was selected as the standard package for comparing base stocks in the panel test. A lubricant using this additive package may or may not satisfy all the specifications of the MIL-L-23699C specification.

In this bench panel test, a stainless steel panel is electrically heated by means of two heaters which are inserted into holes in the panel. The temperature is monitored by means of a thermocouple. The panel is placed on a slight incline and heated to 540° F. The lubricant to be tested is dropped onto the heated panel and the characteristics are observed. The lubricant contacts the panel near the top of the incline and is observed as a central dark band. The lubricant then tends to thin out as it travels towards the pointed end of the heated panel. It is along the oil-air-metal interface that the degradation of the lubricant is best observed.

The results of the panel test for a composition prepared in accordance with the composition of Run 9 of the Example showed little degradation along the oil-air-metal interface. This lubricant is an ester mixture formed by reacting monopentaerythritol and trimethylpropane with an acid mixture including heptanoic, capric-caprylic and iso-nonanoic acids.

The panel test results for a lubricant of an ester mixture of about 70 weight percent trimethylolpropane esters and 30 weight percent dipentaerythritol esters showed increased carbonization along the oil-air-metal interface.

In FIG. 3, the lubricant formed from pentaerythritol esters formed by reacting technical grade pentaerythritol which includes between about 85–88 weight percent of monopentaerythritol and about 11–13 weight percent of dipentaerythritol with an acid mixture an acid mixture including branched-chain acid, namely an iso-$C_5$ component commonly referred to as with iso-pentanoic acid includes about 40 weight percent of the iso-$C_5$ and about 60% valeric or normal $C_5$ acid exhibited increased carbonization and depositing along the oil-air-metal interface compared to that of the composition prepared in accordance with the invention.

By providing a mixture of synthetic esters prepared without any significant amount of dipentaerythritol in accordance with the invention, a synthetic ester lubricant which exhibits a reduced tendency to form deposits compared to conventional synthetic ester mixtures is obtained. The ester mixture is prepared by esterifying at least one of monopentaerythritol and trimethylpropane with an acid mixture of normal $C_5$–$C_{10}$ acids and an iso-nonanoic acid. The mixture of esters prepared in accordance with the invention are compatible with conventional lubricant additives which are conventionally added to improve the properties of the synthetic ester mixtures. Minor amounts of such additives include: oxidation inhibitors, corrosion inhibitors, metal passivators and the like which tend to add slightly to the viscosity, and improve the high temperature properties and the load factor of the final lubricant.

It will thus be seen that the objects set forth above, among those made apparent from the preceding description, are efficiently attained and, since certain changes may be made in the above composition of matter without departing from the spirit and scope of the invention, it is intended that all matter contained in the above description shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Particularly it is to be understood that in said claims, ingredients or compounds recited in the singular are intended to include compatible mixtures of such ingredients wherever the sense permits.

What is claimed is:

1. A synthetic ester lubricant base stock, consisting essentially of the reaction product of:

a polyol selected from the group consisting of monopentaerythritol having a melting point of 255°–259° C., trimethylolpropane and mixtures thereof; and an acid mixture including (1) at least one straight-chain acid having between about 5 and 10 carbon atoms and (2) an iso-acid selected from the group consisting of iso-$C_7$ acid, iso-$C_8$ acid, iso-$C_9$ acid, iso-$C_{10}$ acid and mixtures thereof;

wherein the resulting mixture of esters has a viscosity at 210° F. of at least about 4.8 centistokes, a viscosity at −40° F. of less than about 13,000 centistokes and a pour point of at least as low as −65° F.

2. The synthetic ester lubricant base stock of claim 1, wherein the iso-acid is iso-nonanoic acid.

3. The synthetic ester lubricant base stock of claim 1, wherein the polyol includes a mixture of monopentaerythritol and trimethylolpropane.

4. The synthetic ester lubricant base stock of claim 3, wherein the monopentaerythritol is present in an amount between about 60 to 90 weight percent of the polyol and the trimethylolpropane is present in an amount between about 10 to 40 weight percent of the polyol.

5. The synthetic ester lubricant base stock of claim 3, wherein the monopentaerythritol is present in the polyol in an amount between about 60 to 80 weight percent and the trimethylolpropane is present in the polyol in an amount between about 20 to 40 weight percent.

6. The synthetic ester lubricant base stock of claim 3, wherein the polyol includes about 71 weight percent monopentaerythritol and about 29 weight percent trimethylolpropane.

7. The synthetic ester lubricant base stock of claim 1, wherein the acid mixture includes between about 5 to 40 weight percent of the iso-nonanoic acid.

8. The synthetic ester lubricant base stock of claim 1, wherein the straight-chain acids include a mixture of at least two acids of valeric acid, heptanoic acid, caprylic acid, pelargonic acid and capric acid.

9. The synthetic ester lubricant base stock of claim 1, wherein the mixture of acids includes heptanoic acid, capric-caprylic acid, pelargonic acid, valeric acid and iso-nonanoic acid.

10. The synthetic ester lubricant base stock of claim 1, wherein the mixture of acids includes heptanoic acid, capric-caprylic acid and iso-nonanoic acid.

11. The synthetic ester lubricant base stock of claim 10, wherein the straight-chain acid is present in the acid mixture in an amount between about 60 to 95 weight percent with the remainder being iso-nonanoic acid.

12. The synthetic ester lubricant base stock of claim 10, wherein the straight-chain acid is present in the acid mixture in an amount between about 70 to 90 weight percent with the remainder being iso-nonanoic acid.

13. The synthetic ester lubricant base stock of claim 1, admixed with an effective amount of a synthetic ester lubricant additive package for improving the high temperature properties and the load factor of the lubricant.

14. A synthetic ester lubricant base stock consisting essentially of the reaction product of:

a polyol mixture consisting of monopentaerythritol having a melting point of 255°–259° C. and trimethylolpropane, a mixture of monocarboxylic acids including (1) straight-chain acids having from 5 to 10 carbon atoms and (2) isononanoic acid, and the resulting ester having a viscosity at 210° F. of at least about 4.8 centistokes, a viscosity at −40° F. of less than about 13,000 centistokes and a pour point of at least as low as −65° F.

15. The synthetic ester lubricant base stock of claim 14, wherein the mixture of acids includes heptanoic acid, capric-caprylic acid and iso-nonanoic acid.

16. The synthetic ester lubricant base stock of claim 14, admixed with an effective amount of a synthetic ester lubricant additive package for improving the high temperature properties and load factor of the lubricant.

17. The synthetic ester lubricant base stock of claim 1, wherein the iso-$C_9$ acid is 3,5,5-trimethylhexanoic acid.

18. The synthetic ester lubricant base stock of claim 14, wherein the iso-nonanoic acid is 3,5,5-trimethylhexanoic acid.

19. The synthetic ester lubricant base stock of claim 14, wherein the acid mixture further includes at least one iso-acid acid selected from the group consisting of iso-$C_7$ acid, iso-$C_8$ acid, iso-$C_{10}$ acid and mixtures thereof.

* * * * *